US005791173A

United States Patent [19]

Montes

[11] Patent Number: 5,791,173

[45] Date of Patent: Aug. 11, 1998

[54] KEY-ACTUATED SECURITY BAR FOR A DOOR

[76] Inventor: Cedrick B. Montes, 10688 Sleepy Brook Way, Boca Raton, Fla. 33428

[21] Appl. No.: 914,517

[22] Filed: Aug. 19, 1997

Related U.S. Application Data

[63] Continuation of Ser. No. 594,014, Jan. 30, 1996, abandoned.

[51] Int. Cl.[6] ..... E05B 65/06

[52] U.S. Cl. ..... 70/101; 70/94; 292/259

[58] Field of Search ..... 70/94, 95, 101, 70/124, 135, 139; 292/259, 288, 289, 338, 339

[56] References Cited

U.S. PATENT DOCUMENTS

| | | | |
|---|---|---|---|
| 1,695,686 | 12/1928 | Hess | 70/94 |
| 1,707,694 | 4/1929 | Torrence | 292/259 X |
| 1,988,080 | 1/1935 | Kemp et al. | 70/94 |
| 2,163,206 | 6/1939 | Lopez | 292/259 |
| 2,373,783 | 4/1945 | Schlifer | 70/101 |
| 2,421,275 | 5/1947 | Lopez | 292/259 |
| 3,527,068 | 9/1970 | Gervis et al. | 70/94 |
| 3,971,238 | 7/1976 | Walker | 70/135 |
| 4,462,625 | 7/1984 | Barnhill | 292/259 |
| 4,601,503 | 7/1986 | Wicks, Sr. | 292/259 |
| 5,010,747 | 4/1991 | Norden, Jr. | 70/94 |

FOREIGN PATENT DOCUMENTS

| | | | |
|---|---|---|---|
| 971733 | 1/1951 | France | 70/101 |
| 83773 | 4/1909 | Germany | 70/101 |

*Primary Examiner*—Suzanne Dino Barrett

*Attorney, Agent, or Firm*—Malin, Haley, DiMaggio & Crosby

[57] ABSTRACT

An improved security system for a door that opens inwardly or outwardly, that includes a bar having on one side of the door jamb a U-shaped bracket for locking the bar across the door, preventing its movement inwardly, a double hinge joint on the opposite side, securing the bar to the door jamb, and a key-actuated locking mechanism that includes an actuating fork that raises the security bar at one end away from the U-shaped locking bracket, thereby allowing the door to be opened, and in a second position, disengaging the lever arm from the security bar, causing the security bar to be firmly engaged in the U-shaped lock on the door jamb.

1 Claim, 5 Drawing Sheets

KEY-ACTUATED SECURITY BAR FOR A DOOR

This application is a continuation of application Ser. No. 08/594,014, filed Jan. 30,1996 and now abandoned.

BACKGROUND OF THE INVENTION

1. Field of the Invention

This invention relates generally to a rigid security apparatus for hinged doors that is used to prevent the opening of a door by force, and in particular, to a rigid bar mounted to a door jamb, suitable for a door that opens inwardly or outwardly. The security bar can be activated by a key from the outside of a door to either engage or disengage the door bar.

2. Description of the Prior Art

Home security has become a very large problem in recent times. Conventional locks, and even deadbolt locks, do not always adequately keep a door locked to prevent unauthorized access through the door. Oftentimes, door jamb locking bolt housings can be opened using crowbars and the like, permitting access through the door.

The use of one or more rigid bars across and between door jambs attached to the wall structure on the inside of a dwelling are known in the prior art. Such rigid bars are very effective to prevent unauthorized entry through the door, in that it would take extreme force to force the door open, based on the rigid structure of the interior door bars. Rigid bars have been used to prevent sliding glass doors from moving along their channels as shown in U.S. Pat. No. 5,022,245 and U.S. Pat. No. 3,821,884. The great drawback of those door bars, however, is that, although easily placed in wall brackets across the door surface from the inside of the house, they do not provide security when one must exit through the door and lock the door behind. The majority of the door locking bars prevent the entry, be it lawful or unlawful, of any one from the opposite side of the door where those bars are positioned. U.S. Pat. No. 3,809,417 and U.S. Pat. No. 4,135,376 illustrate such devices.

Locking bars which allow for locking or unlocking a door either from the inside or the outside have been shown in the prior art as illustrated in U.S. Pat. No. 5,010,747 and U.S. Pat. No. 2,373,783. The door locking mechanisms shown in the prior art, however, are complex in operation and construction.

A need exists for an improved door locking mechanism which can be easily mounted on existing door structures that open inwardly or outwardly, are non-complex in operation, and are cost effective.

The present invention provides for a key-actuated locking mechanism that can engage and disengage the rigid door bar, preventing unauthorized access in the locked position, while making access easy in the unlocked position.

SUMMARY OF THE INVENTION

This invention relates generally to a security apparatus for locking a hinged door that includes a bar that prevents the opening of a hinged door by force, and in particular, to a security bar locking apparatus for a hinged door, both inwardly and outwardly opening hinged doors, to prevent unauthorized access, comprising a bar adjustable in length to reach between parallel, vertical, opposing door jambs of the door to be secured, a pivotal hinge bracket mounted to one door jamb of the inside room connected to the security bar, a second, U-shaped bracket mounted on the opposing jamb for receiving said bar in a locked position which prevents opening of the door, and a key-actuated linear lock connected through the door, having a linear raising lever that permits the door security bar to be raised vertically, away from the security bracket on the jamb in a first position and a second position that allows the bar to drop into the bracket, locking the door.

The security apparatus in accordance with the invention has two embodiments, one which permits securing a door that opens inwardly into the inside room, and the second embodiment of which permits securing a door that opens outwardly away from the inside room.

INWARDLY OPENING DOOR

The rigid security bar may be made of a very sturdy wood or preferably steel or other rigid metal, and may be sized 1 to 2 inches wide and thick, and at least sufficiently long enough to reach both parallel door jambs (vertical) on each side of the door, at least 2½ to 3 feet long.

A hinged bracket is permanently mounted on the door jamb on the hinged side of the door that includes a pivotal bar fastener that allows the security bar to move vertically while also allowing the bar to swing inwardly with the door in the direction of the door. The rigid bar is connected to the pivotal bracket at one end.

A permanent, U-shaped bracket is mounted to the opposite door jamb at such a height to be parallel to the opposing hinged bracket, which allows the bar to be positioned by gravity in the U-shaped bracket in the locked position so that the door is secured.

Mounted through the door is a tumbler-type lock that is activated by a key that, on the side of the door inside the room, has a linear rod that engages the rigid bar. When the key is inserted, the tumbler can be rotated, lifting linearly the rod engaging the bar, lifting the bar above and out of the security bracket on the door jamb, which will allow the door to be opened inwardly. Simultaneously, the opposite end of the bar attached to the hinged bracket pivots upwardly and with the door.

To secure the door in the locked position, the security bar is in a down position, the tumbler-movable rod is disengaged from the bar. The free end of the bar rests in the bottom of the U-shaped bracket connected to the door jamb.

To utilize the device, the bar can be manually placed in the U-shaped permanent bracket from the inside room, securing the door. There is also a rotatable, manually-actuated handle to lift the rod linearly to raise the bar away from the security bracket to unlock the door.

When leaving the dwelling, a person locks the door from outside the dwelling by rotating the key-actuated tumbler, which lowers the linearly moving rod and the security bar, causing the free end of the security bar to drop by gravity into position in the door jamb bracket. This allows the security bar inside the room to be firmly locked in place from outside the dwelling. Upon the person's return, to open the door, the key-actuated tumbler is rotated so that the rod moves linearly, engaging the bar, forcing the bar upward away from the jamb security bracket, which permits the door to be opened.

Note that due to the mechanical non-complexity of the system, the various elements of the system can be very strong and sturdy, such that the first jamb hinged bracket permanently attached to one end of the security bar that allows for upward pivoting and hinge rotational movement in the plane of the door can be made of a very strong steel permanently anchored into the jamb.

Likewise, the releasable, U-shaped security bracket that engages and disengages the locking bar can also be very strong and very firmly attached to the jamb structure.

Based on the structure and function of the present invention, it is clear that it can be sold as an after-market item and can be conveniently installed in existing dwellings for doors that open inwardly, which is how most doors open for dwellings. The type of door jamb or door lock does not matter since the system herein is independent and can be used in conjunction with other existing door locks, such as double deadbolts or the handle-actuated locks found on the door.

OUTWARDLY OPENING DOOR

In an alternate embodiment, the security bar can be modified such that a locking bar can be used across the door jambs while still permitting the door, when unsecured, to open outwardly. In this embodiment, the security bar, instead of being completely rigid from one end to the other, includes a midsection hinge that allows the free end to swing upwardly near the security bracket on the door jamb such that its travel allows it to be positioned to lie within the plane of the door itself, outside the plane of the door jamb, which thus allows the door to open outwardly.

The tumbler key-activated lock mechanism that pushes an activating rod linearly upwardly still works in the same manner, although the deactivated lock may be mounted in a different position on the door, closer to the free end of the security bar.

The fixed, attached end of the security bar has an outwardly projecting hinge portion that allows it to swing freely as the door opens outwardly, away from the door jamb so that it does not bind, causing the door to not open freely outwardly.

The security bar also includes a fixed clamp that allows it to hold the security bar in position so that the hinged free end of the security bar can freely move upwardly to sufficiently clear the door jamb in the plane of the door.

Thus, in the secured or locked position, in effect the security bar proceeds from one door jamb to another, from a fixed, attached end of the security bar to a bracket on the opposite door jamb (U-shaped) that holds the bar in place, preventing movement of the door in either direction.

To open the door, the key-activated tumbler is rotated, causing an activating rod to move linearly upwardly, pushing the hinged portion of the free end of the security bar away from the door jamb, out of the plane of the door jamb, allowing free movement of the door in the unlocked position.

One of the important components of the invention is the tumbler key-activated lock that has a series of lever arms in a rigid bracket whereby once the tumbler is rotated causing a pivot arm to rotate, the motion is translated to a linear vertical motion through the housing and slide mechanism, forcing a slide or rod that activates the bar in a pure vertical motion.

The key can then be used from both sides of the door, whether it is outside the dwelling or in the inside room of the dwelling, for moving the rod vertically, which causes the security bar to either be disengaged in one direction linearly or allowing gravity to allow the bar to drop vertically into the securing bracket on the door jamb in the locked position.

It is an object of this invention to provide a security bar to prevent unauthorized opening of a door, regardless of whether the door opens outwardly or inwardly, from a key-activated tumbler mechanism.

It is an object of this invention to provide an extremely sturdy locking bar to prevent unauthorized access through a doorway, preventing a door from being opened, that can be key-actuated from the outside of the door and manually-actuated from the inside of the door.

It is another object of this invention to provide a low cost, high gain security device to prevent unauthorized brute force access through doorways that can be readily installed in existing doors that open inwardly.

And yet still another object of this invention is to provide an extremely secure door guard to prevent unauthorized access through the door, regardless of the locking bolt setup on the door system.

But yet still another object of this invention is to provide an improved, key-activated tumbler lock that provides for an activating rod to move linearly, moving the security bar to the desired location.

In accordance with these and other objects which will become apparent hereinafter, the instant invention will now be described with particular reference to the accompanying drawings.

DESCRIPTION OF THE PREFERRED EMBODIMENTS

Figure 1:
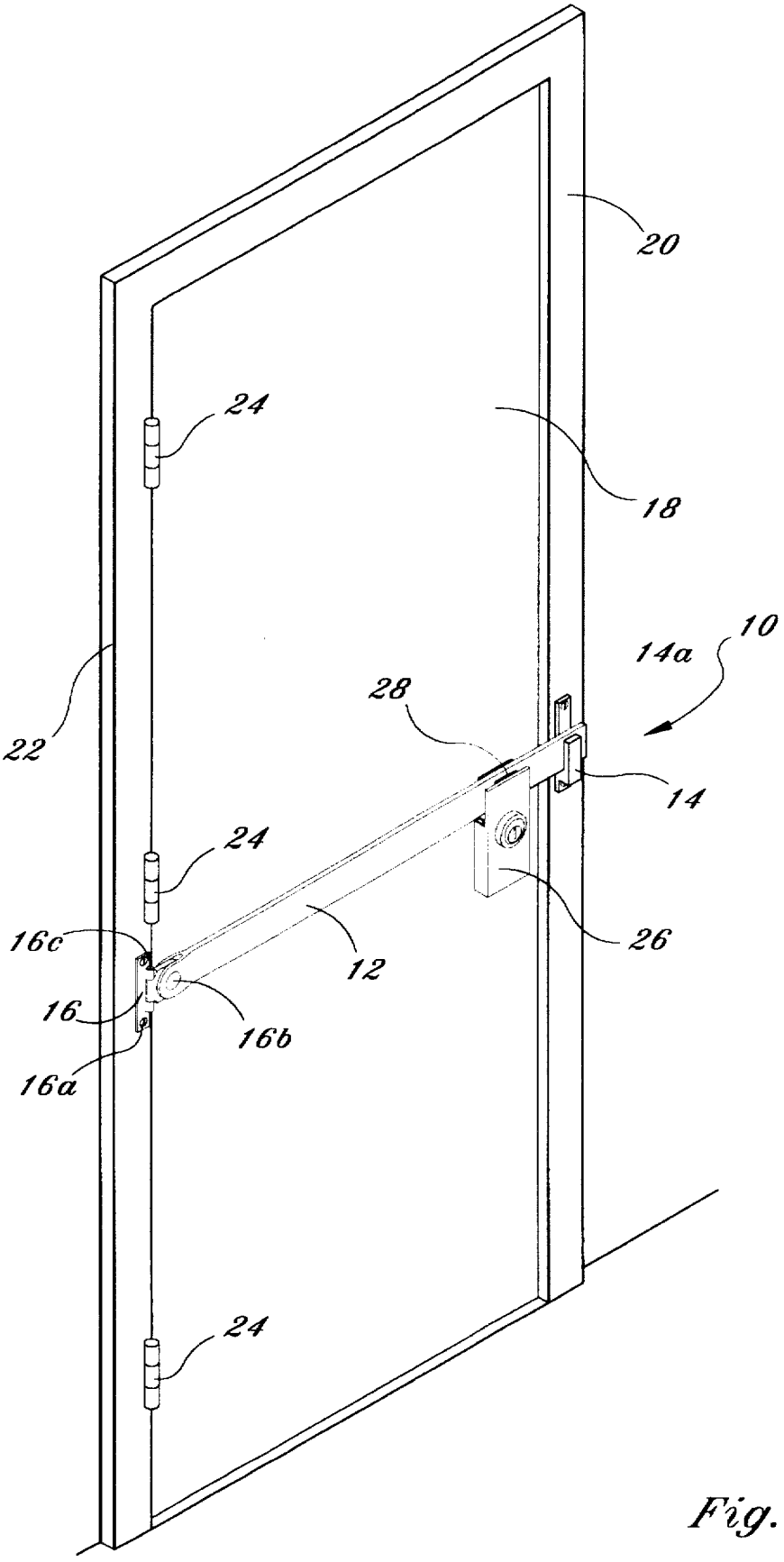
FIG. 1 shows a perspective view of the present invention mounted on a door, viewed from the inside of the room, with the door being one that opens inwardly towards the viewer, with the security bar in the locked position.

Referring now to the drawings, and in particular to FIG. 1, the present invention is shown generally at 10, comprised of a security bar 12 that may be a rigid, somewhat square or rectangular in cross section bar made of metal or wood, that is sized to extend wider than door 18 between door jambs 20 and 22. With the security bar 12 in the down and locked position as shown, the bar 12 is held firmly in position on one side by U-shaped bracket 14 that is permanently attached by screws **14*a* to door jamb 20, and on the other side by a dual-functioning, pivotal bracket 16 that includes two hinges, which is also permanently attached by screws 16*a* to door jamb 22. Thus, in this position, the door 18, which is hinged to door jamb 22 by conventional hinges 24 cannot open inwardly due to the position of the security bar 12. Security bar hinge 16*b* permits vertical rotational movement of bar 12. Hinge 16*c* permits bar 12** to swing inwardly when the door is opened inwardly.

Permanently mounted in door 18 is a key-actuated lock 26 that moves an actuating fork 28 that is mechanically attached to the key-actuated lock 26. Manually rotating a key in lock 26 linearly moves actuating fork 28 upwardly. In the door locked position of FIG. 1, bar 12 rests by gravity firmly in U-shaped bracket 14, keeping the door locked.

Figure 2:
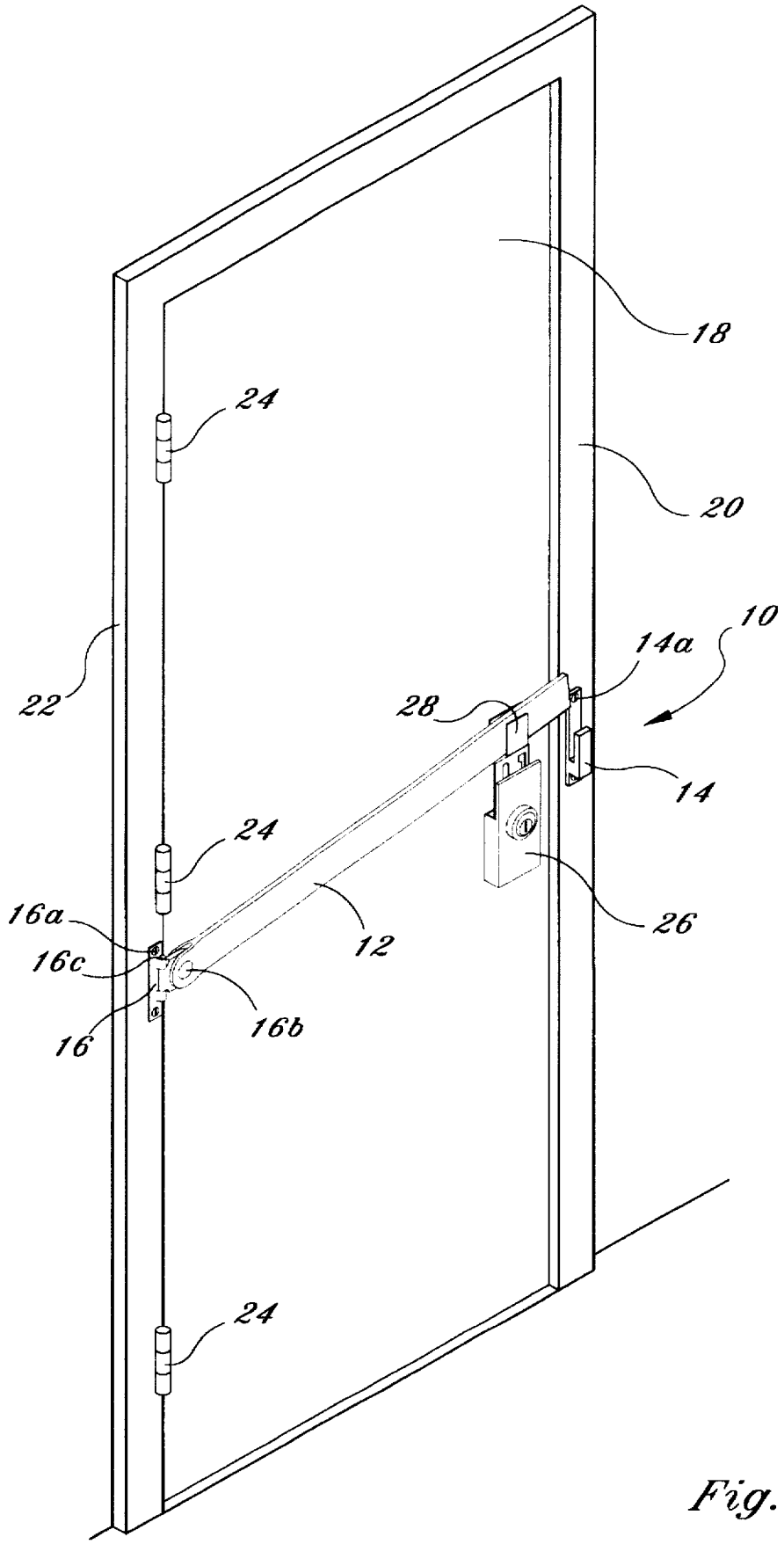
FIG. 2 shows a perspective view of the device in FIG. 1, with the security bar in the unlocked position, which permits the door to be opened inwardly toward the viewer.

Referring now to FIG. 2, the key-actuated lock 26 tumbler has been manually rotated by key action from either the outside of the door on the other side, or manually on the inside to linearly lift actuating fork 28 into lifting engagement of the free end of security bar 12, raising bar 12 above the U-shaped bracket 14. This position allows the door 18 to be opened inwardly due to the pivot motion at hinge **16*b* where the security bar 12 pivots upwardly, while at the same time hinge 16*c* allows the entire bar to pivot inwardly with the movement of the door 18. The door 18 opens inwardly toward the viewer. In the position of the security bar 12 in FIG. 2, the door can be opened and closed in a conventional manner. Upon leaving the dwelling, however, with key in hand, the operator can manually lock 26 with a key from the outside of the dwelling, causing actuating fork 28 to linearly move downwardly, causing bar 12 to drop by gravity into U-shaped bracket 14, securely locking the door 18** from outside the room.

Figure 3:
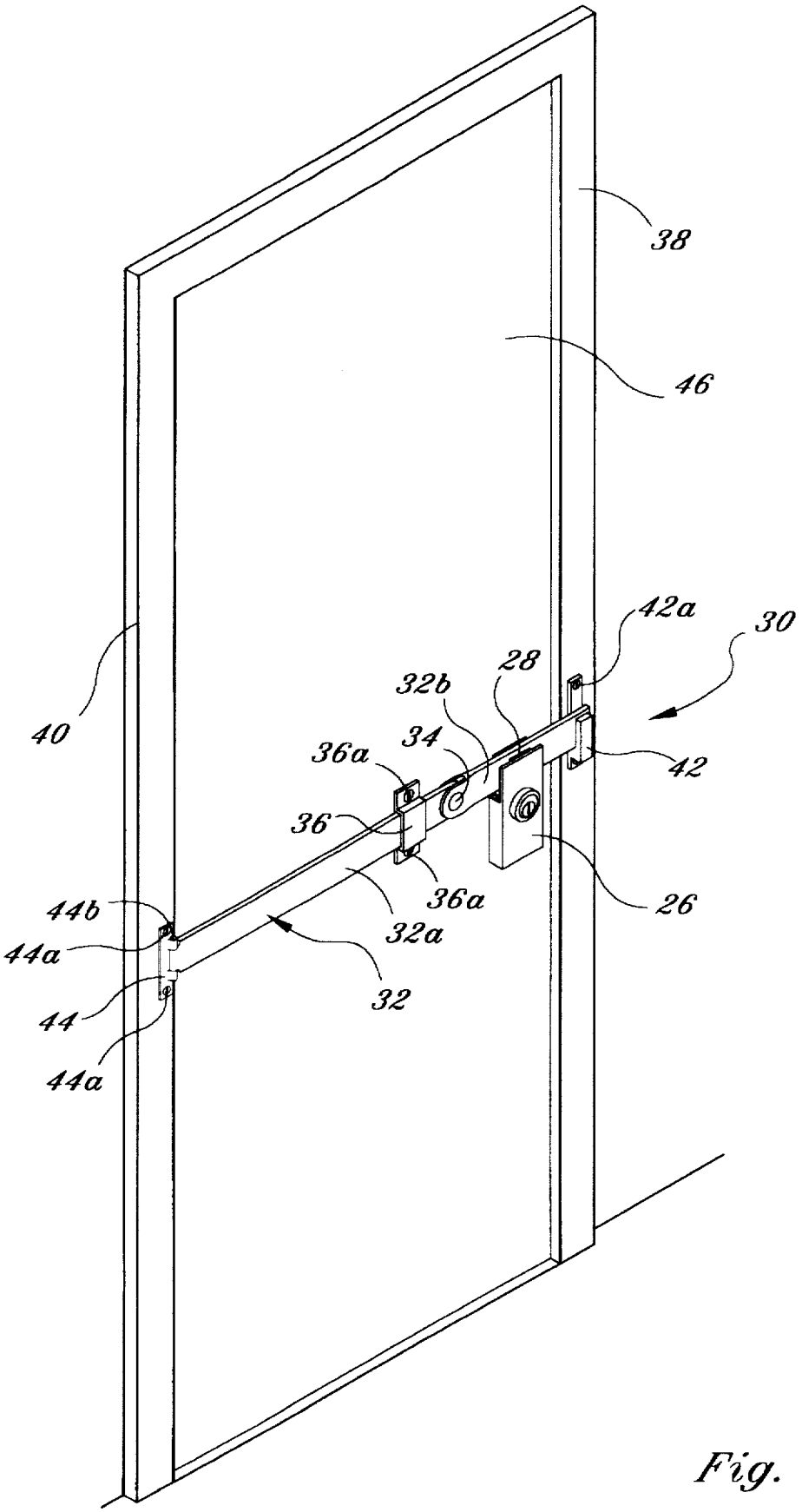
FIG. 3 shows an alternate embodiment of the invention in a perspective view, viewed from the inside of a room of a door that opens outwardly away from the viewer, with the security bar in a locked position.
Figure 4:
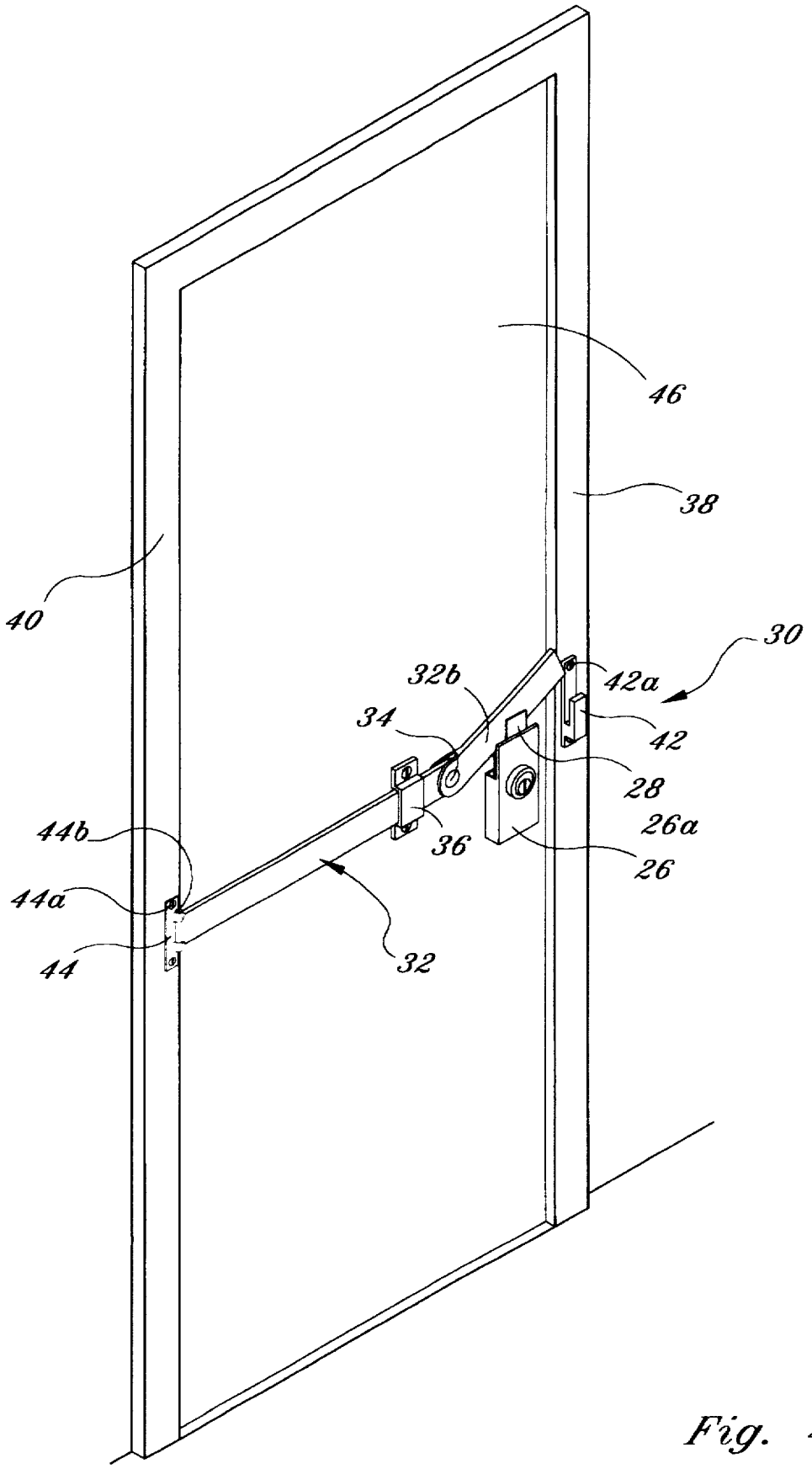
FIG. 4 shows the perspective view of the invention as shown in FIG. 3 with the security bar in the unlocked position.

Referring now to FIGS. 3 and 4, an alternate embodiment of the invention is shown generally at 30, which provides for security bar 32 for doors that open outwardly or in the views of FIG. 3 and FIG. 4, away from the viewer.

With the door 46 that opens outwardly, the movable free end of security bar **32*b* must clear door jamb 38 when the door is opened and must sufficiently be hinged and pivot in the outwardly direction to clear jamb 40**.

As shown in FIG. 3, the free end of security bar **32*b* is firmly locked in U-shaped bracket 42 which is mounted by threaded connectors 42*a* to door jamb 38** in a locked position.

A key-actuated lock 26 is the same as shown in FIGS. 1 and 2 and includes the same mechanism, including an actuating fork 28 that is moved linearly by rotation of a key mounted in lock 26 to move the free end of security bar **32*b* which pivots at hinge 34, and which is attached to a rigid arm 32*a* firmly held relative to door 46 by a bracket 36 which is mounted by threaded connectors 36*a* to the door 46**.

One end of bar **32*a* is hingedly attached to hinge 44 which is mounted to door jamb 40 by threaded connectors 44*a*. The hinge 44*b* is spaced out away from door jamb 40 sufficient to allow clearance when the door is opened outwardly or away from the viewer as shown in FIGS. 3 and 4. In the locked position shown in FIG. 3**, the door cannot be opened inwardly or outwardly.

Referring now to FIG. 4, the alternate embodiment 30 of the invention shown in FIG. 3 is shown with the free end of security bar **32*b* being raised by actuating fork 28 to such a position that it clears door jamb 38 when door 46 is opened outwardly away from the direction of the viewer. The tumbler lock 26*a*, which is activated by a key that is inserted into tumbler 26*a*, can be manually rotated and the tumbler is mechanically connected to actuating fork 28, which is a U-shaped metal bracket and support that can engage security bar 32*b* to allow it to be raised or lowered by rotating tumbler 26*a* and the mechanical linkage interlock which is described below. The identical tumbler lock 26*a* includes a key opening on the outside of the door, outside the dwelling, so that the security bar can be actuated from either side of the door by insertion of a key into tumbler 26*a***.

Figure 5:
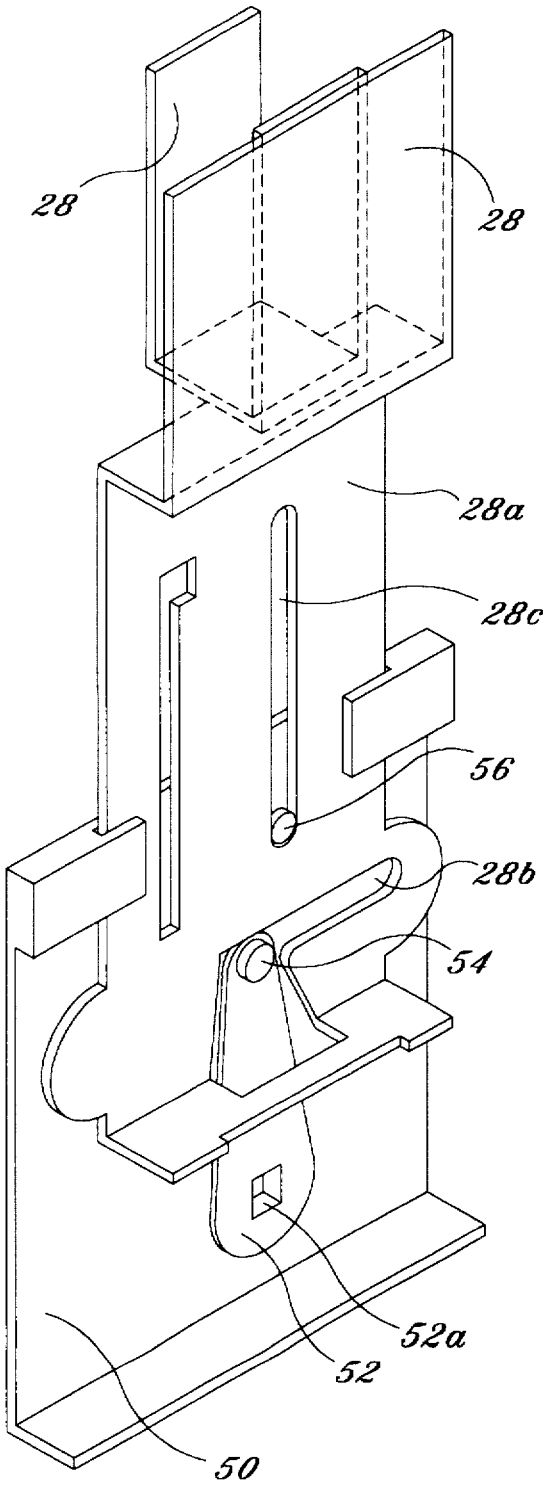
FIG. 5 shows a linear actuating mechanism used with a tumbler lock to raise the security bar, and is shown in an up position.
Figure 6:
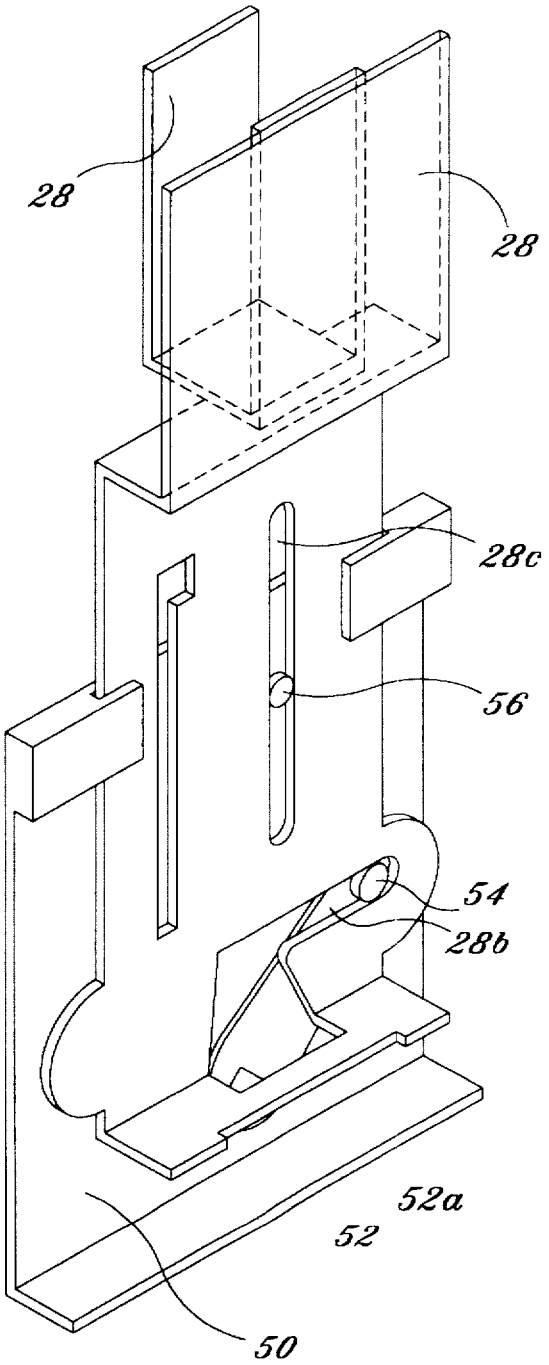
FIG. 6 shows a perspective view of the linear actuating mechanism as shown in FIG. 5 with the mechanism in the down position.

FIGS. 5 and 6 show a linkage mechanism that connects the tumbler of lock 26 that is key-rotated manually to a lever arm 52 having a rectangular aperture **52*a* that receives a rectangular shaft tumbler in lock 26. The device in FIGS. 5 and 6 are to convert rotational motion caused by the tumbler rotation in lock 26**.

An actuating fork 28 has a U-shaped top that receives the free end of the security bar 12 in all of the embodiments. The actuating fork 28 includes a stabilizing or linear stabilizing slot **28*c* in body portion 28*a* that receives a guide 56 that forces the actuating fork 28 to slide linearly up and down. 50 represents a portion of housing of the overall lock mechanism 26 which moves relative to the actuating fork 28. Lever 50 which rotates about aperture 52*a* that receives a shaft (not shown) has a guide 54 which rides along slot 28*b*, converting rotation motion and forcing the actuating fork 28 to move up and down linearly. Housing 50 is mounted firmly against the door in the overall housing so that it does not move relative to the door. 50 is also attached to the lock mechanism in that the tumbler has a shaft connected to rectangular aperture 52*a* and to lever arm 52. Thus, lever arm 52 and housing 50 do not move, but are firmly attached to the door. Lever arm 52 does rotate, causing the actuating fork 28 to move up and down. As shown in FIG. 5, the actuating arm is raised to the top position, which would indicate unlocking the security bar. As shown in FIG. 6, the actuating fork 28** is in the down position, which would indicate a locked position for the security bar relative to the door. Thus, by simply inserting a key into the tumbler lock from either side of the door, and regardless of whether the door opens inwardly or outwardly, the key-actuated locking and unlocking mechanism, especially which causes linear motion, provides a non-complex device for raising and lowering the security bar.

One of the primary advantages of the present invention is that it can be easily installed on existing doors that open inwardly or outwardly. Therefore, by mounting U-shaped bracket 14 on one door jamb with a simple drill and threaded fasteners, such as screws, the double hinge 16 on the other door jamb, and drilling a small hole through the door so that the key-actuated lock can be installed through the door, the system is ready for immediate use. The system is used with an existing door lock, even a deadbolt. The security bar 12 adds a much larger measure of security, so that even if someone could move the lock bolt in a conventional knob and lock, the security bar 12 will keep the door from being forced open.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A security system for securely locking a door that opens outwardly or inwardly mounted in a wall opening, the opening having first and second parallel vertical door jambs and one or more conventional door hinges connected to the door and to the first door jamb, said security system comprising:

a rigid elongated security bar sized to extend substantially horizontally acce-ss the width of the door, overlapping the first and the second door jambs on each side;

a first security bar hinge mounted to the first door jamb;

a U-shaped bracket mounted vertically on the second door jamb;

said security bar having a first end securely mounted to said first security bar hinge, said first security bar hinge permitting horizontal pivotal motion of said security bar, said first security bar hinge outwardly projecting from the first door jamb to provide for said security bar swinging freely and clear of the first door jamb as the door is opened outwardly;

a second security bar hinge connected to said security bar between said first end and a second end for vertically pivoting at least a portion of said security bar;

a support bracket, mounted to the door, for vertical support of said security bar, said support bracket including means for slidably receiving said security bar between said second security bar hinge and said first end, wherein said security bar is horizontally slidable within said support bracket permitting the door to be opened outwardly, said security bar being positioned by said support bracket to be received at said second end by said U-shaped bracket on the second door jamb when the door is closed; and a key-actuated lock with the key usable from the outside and inside of the door, mounted through the door, said key-actuated lock including a rotatable tumbler and actuating fork attached movably to said tumbler on the inside of the door, positioned relative to said security bar so that in a first position, said actuating fork vertically positioning said security bar above the U-shaped bracket on the second door jamb, said security bar pivoting at said second security bar hinge, and in a second position, said actuating fork vertically positioning said security bar to be received at said second end into said U-shaped bracket, thereby securing the door from opening.

* * * * *